US008451298B2

(12) United States Patent
Silverstein et al.

(10) Patent No.: US 8,451,298 B2
(45) Date of Patent: May 28, 2013

(54) MULTI-LEVEL STOCHASTIC DITHERING WITH NOISE MITIGATION VIA SEQUENTIAL TEMPLATE AVERAGING

(75) Inventors: Louis D. Silverstein, Scottsdale, AZ (US); Alan Lewis, Sunnyvale, CA (US); Jennifer L. Gille, Menlo Park, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 1413 days.

(21) Appl. No.: 12/121,706

(22) Filed: May 15, 2008

(65) Prior Publication Data

US 2009/0201318 A1 Aug. 13, 2009

Related U.S. Application Data

(60) Provisional application No. 61/028,465, filed on Feb. 13, 2008.

(51) Int. Cl.
*G09G 5/10* (2006.01)

(52) U.S. Cl.
USPC ..... 345/690; 345/596

(58) Field of Classification Search
USPC ..... 345/84, 85, 108, 204, 616, 690, 691, 345/596–600; 359/245, 247, 249, 276, 290, 359/291, 292
See application file for complete search history.

(56) References Cited

U.S. PATENT DOCUMENTS

| | | | | |
|---|---|---|---|---|
| 4,709,995 | A | | 12/1987 | Kuribayashi et al. |
| 4,954,789 | A | | 9/1990 | Sampsell |
| 4,982,184 | A | | 1/1991 | Kirkwood |
| 5,068,649 | A | | 11/1991 | Garrett |
| 5,280,277 | A | | 1/1994 | Hornbeck |
| 5,341,464 | A | * | 8/1994 | Friedman et al. ..... 345/590 |
| 5,475,397 | A | | 12/1995 | Saidi |
| 5,548,301 | A | | 8/1996 | Kornher et al. |
| 5,589,852 | A | | 12/1996 | Thompson et al. |
| 5,784,189 | A | | 7/1998 | Bozler et al. |
| 5,790,548 | A | | 8/1998 | Sistanizadeh et al. |
| 6,040,937 | A | | 3/2000 | Miles |
| 6,147,671 | A | * | 11/2000 | Agarwal ..... 345/691 |
| 6,232,936 | B1 | | 5/2001 | Gove et al. |
| 6,429,601 | B1 | | 8/2002 | Friend et al. |

(Continued)

FOREIGN PATENT DOCUMENTS

| | | |
|---|---|---|
| EP | 0 467 048 | 1/1992 |
| EP | 1 258 860 | 11/2002 |

(Continued)

OTHER PUBLICATIONS

Hsu et al., 2007, Video halftoning preserving temporal consistency, IEEE, pp. 1938-1941.

(Continued)

*Primary Examiner* — Tom Sheng

(74) *Attorney, Agent, or Firm* — Knobbe Martens Olson & Bear, LLP

(57) ABSTRACT

Displays, and methods of displaying images with the displays, which have quantized display characteristics for each of the pixels are disclosed. The displays and methods relate to both spatially and temporally dithering images so that the effective resolution of the display is higher than the result of the native spatial and intensity resolutions of the display, defined by pixel size, pitch, and number of quantization levels of each of the pixels.

32 Claims, 5 Drawing Sheets

U.S. PATENT DOCUMENTS

| | | | | |
|---|---|---|---|---|
| 6,476,824 | B1 * | 11/2002 | Suzuki et al. | 345/690 |
| 6,480,177 | B2 | 11/2002 | Doherty et al. | |
| 6,574,033 | B1 | 6/2003 | Chui et al. | |
| 6,633,306 | B1 | 10/2003 | Marz et al. | |
| 6,636,187 | B2 | 10/2003 | Tajima et al. | |
| 6,674,562 | B1 | 1/2004 | Miles et al. | |
| 6,680,792 | B2 | 1/2004 | Miles | |
| 6,741,384 | B1 | 5/2004 | Martin et al. | |
| 7,110,010 | B1 * | 9/2006 | Masuji et al. | 345/692 |
| 7,123,216 | B1 | 10/2006 | Miles | |
| 7,142,346 | B2 | 11/2006 | Chui et al. | |
| 7,161,728 | B2 | 1/2007 | Sampsell et al. | |
| 7,221,375 | B2 * | 5/2007 | Hall et al. | 345/596 |
| 7,242,512 | B2 | 7/2007 | Chui et al. | |
| 7,327,510 | B2 | 2/2008 | Cummings et al. | |
| 7,388,697 | B2 | 6/2008 | Chui et al. | |
| 7,403,180 | B1 | 7/2008 | Silverstein et al. | |
| 7,710,440 | B2 * | 5/2010 | Masuji et al. | 345/690 |
| 8,189,017 | B2 * | 5/2012 | Chung et al. | 345/694 |
| 2004/0021658 | A1 | 2/2004 | Chen | |
| 2005/0185003 | A1 | 8/2005 | Dedene et al. | |
| 2006/0017746 | A1 | 1/2006 | Weithbruch et al. | |
| 2006/0092173 | A1 * | 5/2006 | Hall | 345/598 |
| 2006/0114542 | A1 | 6/2006 | Bloom | |
| 2006/0119613 | A1 | 6/2006 | Kerofsky | |
| 2006/0145975 | A1 * | 7/2006 | Kempf et al. | 345/84 |
| 2006/0256100 | A1 * | 11/2006 | Masuji et al. | 345/204 |
| 2007/0086078 | A1 | 4/2007 | Hagood et al. | |
| 2007/0291347 | A1 | 12/2007 | Sampsell et al. | |
| 2008/0001867 | A1 | 1/2008 | Chui et al. | |
| 2008/0238911 | A1 * | 10/2008 | Chung et al. | 345/214 |
| 2008/0252959 | A1 | 10/2008 | Chui et al. | |
| 2008/0266333 | A1 | 10/2008 | Silverstein et al. | |
| 2009/0135464 | A1 | 5/2009 | Sampsell et al. | |
| 2009/0213449 | A1 | 8/2009 | Chui et al. | |
| 2010/0321352 | A1 | 12/2010 | Chui et al. | |
| 2011/0075247 | A1 | 3/2011 | Chui et al. | |

FOREIGN PATENT DOCUMENTS

| | | |
|---|---|---|
| EP | 1 482 732 | 12/2004 |
| EP | 1 536 400 | 6/2005 |
| EP | 1 536 632 | 6/2005 |
| JP | 05-113767 | 5/1993 |
| JP | 2000-148068 | 5/2000 |
| JP | 2000-165780 | 6/2000 |
| JP | 2000-293149 | 10/2000 |
| JP | 2002 062493 | 2/2002 |
| JP | 2003-338929 | 11/2003 |
| JP | 2003-345288 | 12/2003 |
| JP | 2006-267924 | 10/2006 |
| KR | 2003 0030470 | 4/2003 |
| WO | WO 03/044765 | 5/2003 |

OTHER PUBLICATIONS

Lieberman et al., 1997, Efficient model based halftoning using direct binary search, IEEE, pp. 775-778.

ISR and WO dated Apr. 9, 2009 in PCT/US09/033247.

IPRP dated Jan. 28, 2010 in PCT/US09/033247.

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

Notice of Reasons for Rejection dated Aug. 21, 2012 in Japanese App. No. 2010-546834.

* cited by examiner

MULTI-LEVEL STOCHASTIC DITHERING WITH NOISE MITIGATION VIA SEQUENTIAL TEMPLATE AVERAGING

CROSS REFERENCE TO RELATED APPLICATIONS

This application claims priority under 35 U.S.C. Section 119(e) to U.S. Provisional Application 61/028,465, filed on Feb. 13, 2008.

BACKGROUND

1. Field of the Invention

The field of the invention relates to displays which have quantized display characteristics for each of the pixels, and more particularly to methods of display which improve the apparent resolution of the display. The invention also relates to optical MEMS devices, in general, and bi-stable displays in particular.

2. Description of the Related Technology

A function of electronic displays, regardless of whether they are monochrome or color displays or whether they are of self-luminous or reflective type, is the generation of graded intensity variations or gray levels. A large number of gray levels are required for high-quality rendering of complex graphic images and both still and dynamic pictorial images. In addition, color reproduction and smooth shading benefit from a relatively high intensity resolution for each primary color display channel. The de facto standard for "true color" imaging is 8 bits per primary color or a total of 24 bits allocated across the three (RGB) primary color channels. However, it is important to recognize that it is the perceived representation, or effective resolution of these bits (producing an effective intensity resolution) and not merely their addressability which ultimately determine display image quality.

Bi-stable display technologies pose unique challenges for generating displays with high quality gray scale capability. These challenges arise from the bi-stable and binary nature of pixel operation, which requires the synthesis of gray scale levels via addressing techniques. Moreover, high pixel density devices are often limited to relatively low temporal frame rates due to fundamental operational constraints and the need for high levels of synthesis for both gray scale and color. These challenges and constraints place emphasis on the need for novel and effective methods of spatial gray level synthesis.

SUMMARY OF CERTAIN EMBODIMENTS

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

One aspect is a method of displaying a first image on a display. The method includes generating a first version of the first image according to a first spatial dither template, generating a second version of the first image according to a second spatial dither template, the second template being different from the first template, and displaying the first image by successively displaying the first and second versions of the first image on the display.

Another aspect is a method of displaying a first image on a display having a native resolution, the method including generating a first version of the first image according to a first template, generating a second version of the first image according to a second template, the second template being different from the first template, and displaying the first and second versions of the first image such that an effective resolution of the first image is higher than the native resolution of the display.

DETAILED DESCRIPTION OF CERTAIN EMBODIMENTS

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Embodiments of the invention more particularly relate to displays which have quantized display characteristics for each of the pixels, and to methods of displaying images with the displays. The displays and methods relate to both spatially and temporally dithering images such that the effective resolution of the display is higher than the result of the native spatial resolution of the display (affected by pixel size and pitch), and the native intensity resolution affected by the number of quantization levels of each of the pixels.

Figure 1:
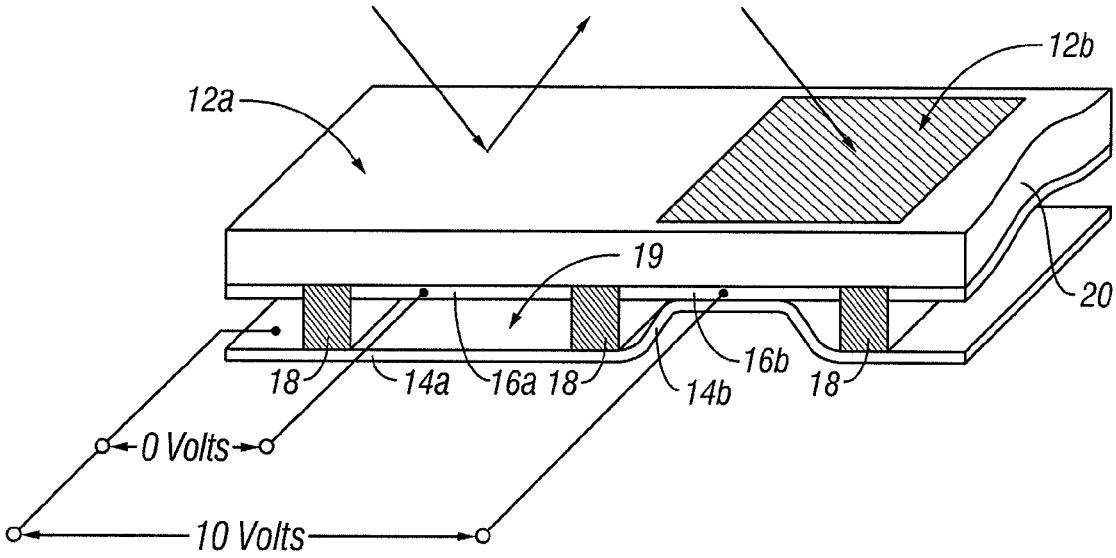
FIG. 1 is an isometric view depicting a portion of one embodiment of a bi-stable display, which is an interferometric modulator display in which a movable reflective layer of a first interferometric modulator is in a relaxed position and a movable reflective layer of a second interferometric modulator is in an actuated position.

An example of display elements which have quantized levels of brightness are shown in FIG. 1, which illustrates a bi-stable display embodiment comprising an interferometric MEMS display element. In these devices, the pixels are in either a bright or dark state. In the bright ("relaxed" or "open") state, the display element reflects a large portion of incident visible light to a user. When in the dark ("actuated" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent pixels 12*a* and 12*b*. In the pixel 12*a* on the left, a movable reflective layer 14*a* is illustrated in a relaxed position at a predetermined distance from an optical stack 16*a*, which includes a partially reflective layer. In the pixel 12*b* on the right, the movable reflective layer 14*b* is illustrated in an actuated position adjacent to the optical stack 16*b*.

With no applied voltage, the gap 19 remains between the movable reflective layer 14*a* and optical stack 16*a*, with the movable reflective layer 14*a* in a mechanically relaxed state, as illustrated by the pixel 12*a*. However, when a potential (voltage) difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by actuated pixel 12*b* on the right in FIG. 1. The behavior is similar regardless of the polarity of the applied potential difference. Because the pixels 12*a* and 12*b* are stable in either of the states shown, they are considered bi-stable, and, accordingly, have selective light reflectivity characteristics corresponding to each of the two stable states. Therefore, the display has a native intensity resolution corresponding to two stable states and a native spatial resolution corresponding to the pitch of the pixels.

Figure 2:
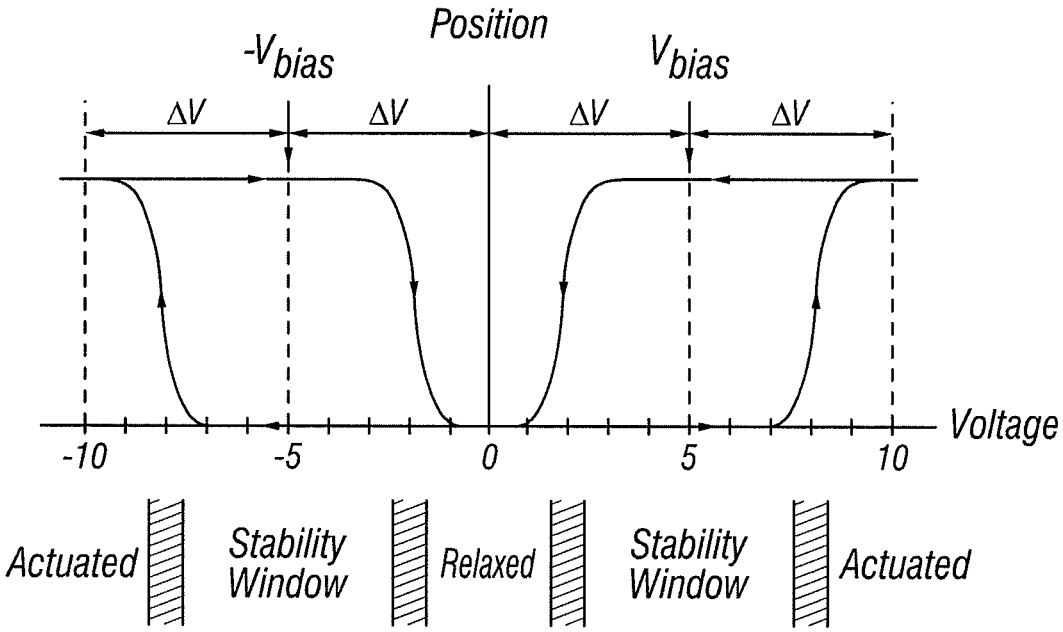
FIG. 2 is a diagram of movable mirror position versus applied voltage for one embodiment of the bi-stable display of FIG. 1.

FIG. 2 illustrates one process for using an array of interferometric modulators in a bi-stable display.

For MEMS interferometric modulators, the row/column actuation protocol may take advantage of a hysteresis property of these devices as illustrated in FIG. 2. An interferometric modulator may require, for example, a 10 volt potential difference to cause a movable layer to deform from the relaxed state to the actuated state. However, when the voltage is reduced from that value, the movable layer maintains its state as the voltage drops back below 10 volts. In the embodiment of FIG. 2, the movable layer does not relax completely until the voltage drops below 2 volts. There is thus a range of voltage, about 3 to 7 V in the example illustrated in FIG. 2, where there exists a window of applied voltage within which the device is stable in either the relaxed or actuated state. This is referred to herein as the "hysteresis window" or "stability window." For a display array having the hysteresis characteristics of FIG. 2, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state or bias voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation.

Figure 3A:
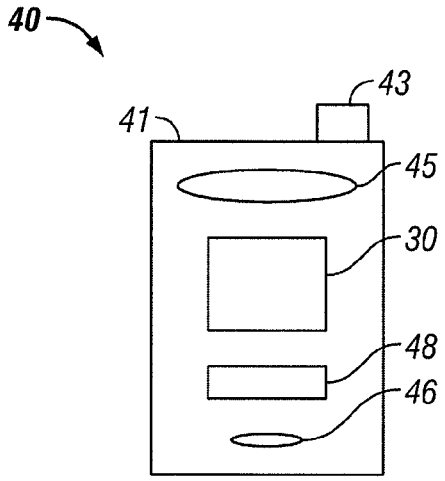
FIGS. 3A and 3B are system block diagrams illustrating an embodiment of a visual display device comprising a bi-stable display.
Figure 3B:
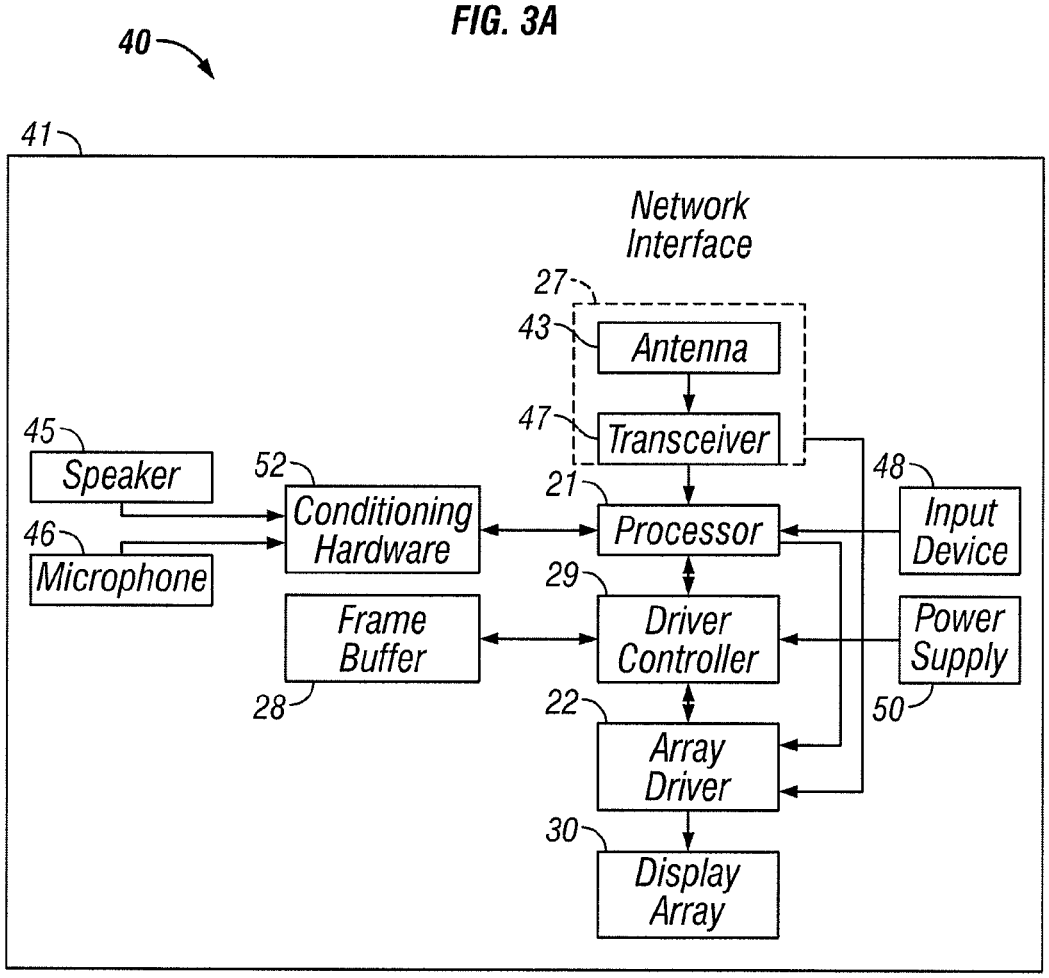

FIGS. 3A and 3B are system block diagrams illustrating an embodiment of a display device 40, in which bi-stable display elements, such as pixels 12*a* and 12*b* of FIG. 1 may be used with driving circuitry configured to spatially and temporally dither images such that the effective resolution of the display is higher than the result of the native spatial and intensity resolutions of the display. The display device 40 can be, for example, a cellular or mobile telephone. However, the same components of display device 40 or variations thereof are also illustrative of various types of display devices such as televisions and portable media players.

The display device 40 includes a housing 41, a display 30, an antenna 43, a speaker 44, an input device 48, and a microphone 46. The housing 41 is generally formed from any of a variety of manufacturing processes, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of display device 40 may be any of a variety of displays, including a bi-stable display, as described herein. In some embodiments, the display 30 includes a flat-panel display, such as plasma, EL, OLED, STN LCD, or TFT LCD as described above, or a non-flat-panel display, such as a CRT or other tube device. However, for purposes of describing certain aspects, the display 30 includes an interferometric modulator display.

The components of one embodiment of display device 40 are schematically illustrated in FIG. 3B. The illustrated display device 40 includes a housing 41 and can include additional components at least partially enclosed therein. For example, in one embodiment, the display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular display device 40 design.

The network interface 27 includes the antenna 43 and the transceiver 47 so that the display device 40 can communicate with one ore more devices over a network. In one embodiment the network interface 27 may also have some processing capabilities to relieve requirements of the processor 21. The antenna 43 is any antenna for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS, W-CDMA or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the display device 40. Conditioning hardware 52 generally includes amplifiers and filters for transmitting signals to the speaker 45, and for receiving signals from the microphone 46. Conditioning hardware 52 may be discrete components within the display device 40, or may be incorporated within the processor 21 or other components.

The input device 48 allows a user to control the operation of the display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the display device 40. When the microphone 46 is used to input data to the device, voice commands may be provided by a user for controlling operations of the display device 40.

In some implementations control programmability resides, as described above, in a driver controller which can be located in several places in the electronic display system. In some cases control programmability resides in the array driver 22.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet. The power supply 50 may also have a power supply regulator configured to supply current for driving the display at a substantially constant voltage. In some embodiments, the constant voltage is based at least in part on a reference voltage, where the constant voltage may be fixed at a voltage greater than or less than the reference voltage.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators). In some embodiments, display array 30 is another display type. One or both of the driver controller 29 and the array driver 22 may be configured to spatially and temporally dither the displayed images such that the effective resolution of the display is higher than the result of the native spatial and intensity resolutions of the display.

Those of skill in the art will recognize that the above-described architecture may be implemented in any number of hardware and/or software components and in various configurations The driver circuitry uses novel and flexible methods for synthesis of a large number of intensity gradations or gray levels on displays with a limited number of native intensity gradations while reducing the visibility of image noise generated by the synthesis process. The methods combine multi-level stochastic spatial dithering with noise mitigation via temporal averaging of images generated using spatial dither templates with varying spatial patterns of threshold template values. The result is a solution to gray-level synthesis in which the number of effective intensity levels may be substantially increased with a minimized impact on visible spatial pattern noise. Such methods can exploit the trade off between display spatial resolution and gray level synthesis while minimizing the introduction of spatial pattern noise or other artifacts which could compromise display image quality.

Spatial dithering is a methodology which trades spatial area (or spatial resolution) for intensity (or gray level) resolution. The methodology consists of a variety of techniques which increase the effective number of "perceived" gray levels and/or colors for devices with a limited number of native gray levels and/or colors. These methods take advantage of the limited spatial resolution of the human visual system (HVS) as well as limitations in HVS contrast sensitivity, especially at high spatial frequencies. Spatial dither originated as an enabling methodology for gray level synthesis in bi-level printing technologies and is currently implemented in one form or another in most printing devices and applications. Since the methodology can provide excellent image quality for imaging devices with high spatial resolution and limited native gray scale capability, it has seen use in both monochrome and color matrix display devices.

Techniques for spatial dither can be divided into two principal categories, point-process methods and neighborhood-operations methods.

Point-process methods are independent of the image and pixel neighborhood resulting in good computational efficiency for displays and video applications. Among the most prominent point-process techniques for spatial dithering are noise encoding, ordered dither and stochastic pattern dither. Noise encoding consists of the addition of a random value to the value of a multi-level pixel input, followed by a thresholding operation to determine the final pixel output value. While effective in increasing the number of effective gray levels, noise encoding generates a spatial pattern with "white noise" characteristics and resulting visible graininess from low spatial frequencies in the noise signal.

Ordered dither is a family of techniques in which a fixed pattern of numbers within a pre-defined X-by-Y region of pixels determines the order or pattern for activating pixels prior to a thresholding operation. The two most notable variations of ordered dither are cluster-dot dither and dispersed-dot dither. They can provide good results but are prone to generating visible, periodic spatial artifacts which interact or beat with the structure of images.

Stochastic pattern dither is similar to ordered dither but the stochastic pattern of the spatial dither template generates a "blue noise" characteristic with minimal spatial artifacts and a pleasing appearance.

Spatial dither methods which rely on neighborhood operations are typified by the technique of error diffusion. In this technique image-dependent pixel gray level errors are distributed or diffused over a local pixel neighborhood. Error diffusion is an effective method of spatial dither which, like stochastic pattern dither, results in a spatial dither pattern with "blue noise" characteristics and minimal spatial or structural artifacts. The drawbacks of error diffusion are that the method is image dependent and computationally intensive and also prone to a peculiar visible defect known as "worming artifacts." Error diffusion is generally not amenable to real-time display operations due to the computationally-intensive, image-dependent nature of the operations.

Multi-level stochastic pattern dither is a somewhat effective approach to gray level synthesis for electronic displays with limited native gray scale capability. Such techniques use dither templates having certain stochastic characteristics to generate dithered versions of the displayed images. The stochastic characteristic of the dither templates is generated by the process in which the dither pattern is created. Two methods for creating stochastic dither patterns with "blue noise" characteristics are the blue-noise mask method and the void and cluster method. The blue noise mask method is based on a frequency domain approach while the void and cluster method relies on spatial domain operations. The void and cluster method of dither template generation relies on circular convolution in the spatial domain. This results in the ability to create small stochastic templates which may be seamlessly tiled to fill the image space of the displayed image.

While multi-level stochastic pattern dither can result in improvement in image quality for displays with limited native gray scale capability, there still remains a problem with residual apparent graininess resulting from the spatial dither pattern. This residual graininess is most visible in the darkest synthesized grade shades and where the display has a relatively small number of native gray levels (e.g., 3 bits or 8 levels).

In order to overcome this limitation, improved multi-level stochastic dither methodologies may be used. The methods mitigate residual pattern noise via temporal averaging of a series of template dithered images in which the synthesized gray levels are generated by different stochastic dither templates. Temporal averaging is achieved by taking advantage of the limited temporal resolution of the human visual system (HVS). Multiple versions of an image are displayed in rapid succession, such that, to an observer, the multiple versions of the image appear as a single image. To the observer, the intensity at any pixel is the average intensity of all of the displayed versions. Accordingly, the observer perceives gray levels between the actually displayed gray levels.

For example, a monochrome display may have pixels which are each either on or off, where the data for each pixel is one bit. Two versions of the image may be created with two different templates. Each of the versions may be displayed in rapid succession, such that the two images appear as a single image. Those pixels which are off in both images will appear dark to the observer, and those pixels which are on in both images will appear with maximum brightness to the observer. However, those pixels which are on in one version and off in the other version will appear with about half the maximum brightness. Accordingly, the observer perceives smoother gray levels across the image.

The multiple versions of the image can be generated using templates which represent mathematical operations to be performed on each pixel of the source image. Different types of templates have various effects on the spatial noise of the displayed image, and on temporal noise of a series of displayed images in the case of video. Therefore, the effect on noise may be considered when determining templates for use.

Figure 4:
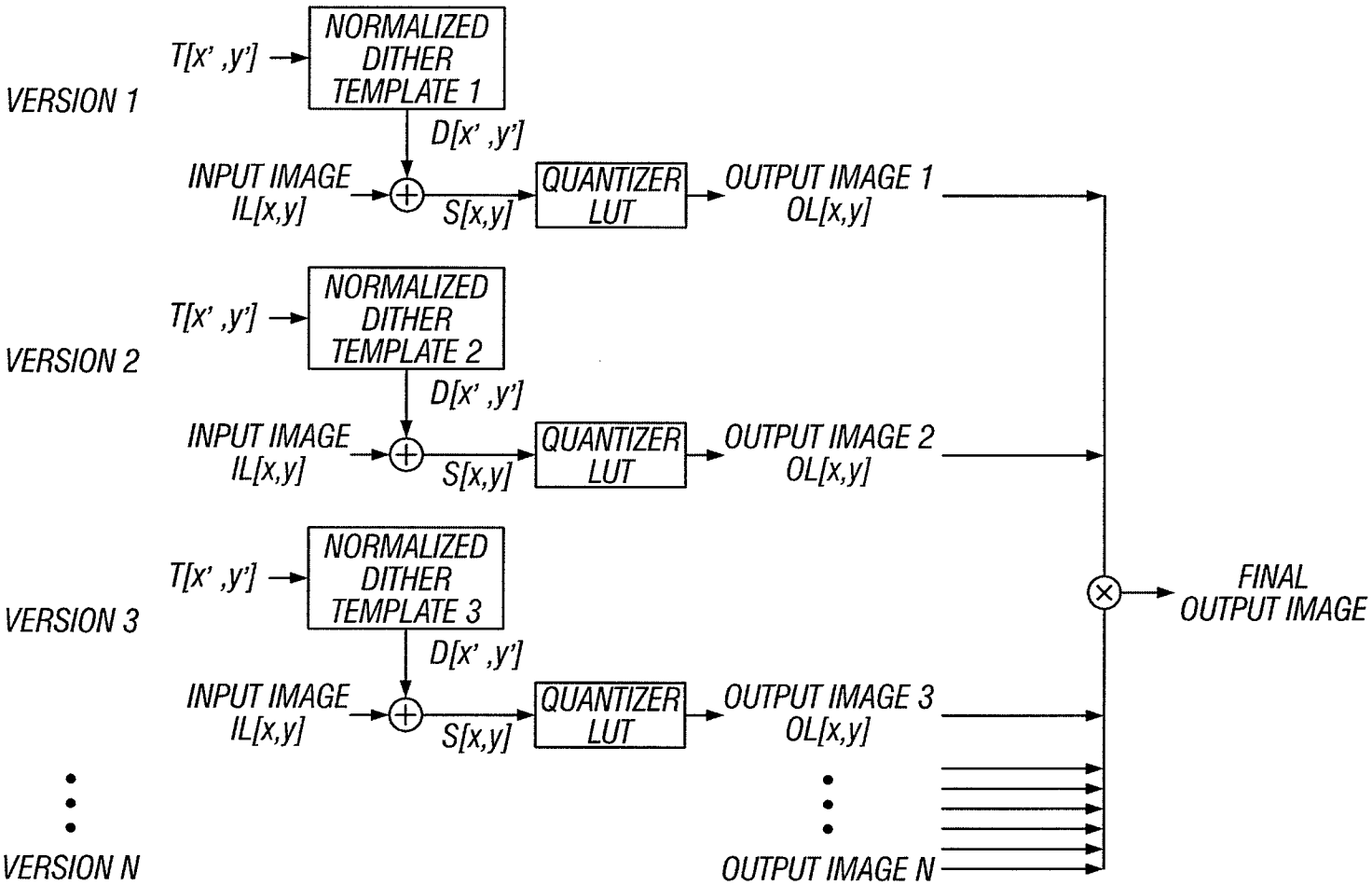
FIG. 4 is a block diagram of one embodiment.

Certain embodiments use multi-level stochastic dither templates, which mitigate residual pattern noise via the temporal averaging of the series of the dithered image versions. As illustrated in FIG. 4, a block diagram of one embodiment shows a multi-level spatial dither methodology in which a series of dithered image versions is generated with different dither templates. Since each of the dither templates will result in a different noise or grain pattern, when these versions are temporally averaged, the result will be a decrease in the pattern noise or an increase in the signal-to-noise ratio.

As shown, for each version, the input image IL[x,y] is operated on according to a normalized dither template D[x', y'], creating a dithered version of the image S[x,y]. In this embodiment, the dithered version of the image S[x,y] is quantized to create the output image OL[x,y]. The result is a series of N versions of the input image IL[x,y], where each version is created with a different template. The final output image is displayed as a sequence of the N versions, displayed in rapid succession such that the versions are temporally averaged. In some embodiments, the sequence of versions may be repeatedly displayed. In some embodiments, the order of the sequence may be altered between re-displayed sequences.

If uncorrelated stochastic templates are used on sequential frames, then the signal-to-noise ratio increases as the square root of the number of averaged dithered images. A variable number of templates from 2 up to N may be used according to the application and the image quality requirements. It is also possible to utilize pre-computed, correlated templates which have a mathematical relationship to one another. Such templates may increase the image signal-to-noise ratio with a smaller number of temporally averaged frames. One example of such a set of templates is the use of pairs of stochastic templates in which the threshold values at each pixel location are inverses of one another.

The method may be readily applied to a variety of display technologies, for example for use in both direct-view and projection applications. The result is a highly effective solution to gray-level synthesis in which the number of effective intensity levels is substantially increased with a high image signal-to-noise ratio.

Figure 5:
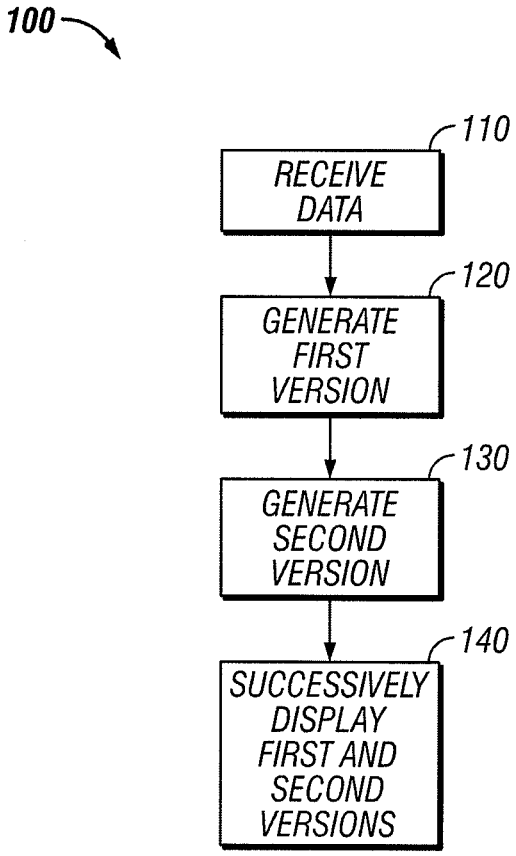
FIG. 5 is a flow chart of a method of an embodiment.

FIG. 5 is a flowchart illustrating an embodiment of a method 100 of displaying an image. The method includes receiving data, generating first and second versions of the image based on the received data, and displaying the image by successively displaying the first and second versions.

In step 110 data representing the image is received. The data has a certain quantization associated therewith. For example, the data may have 24 bits, 8 bits each for the three colors of a single pixel. Other data formats can also be used. If necessary, the data is converted to a format which can be further manipulated as described below.

In steps 120 and 130, first and second versions of the image are generated based on the data received in step 110. The data received in step 110 for each pixel may be modified according to a spatial dither template. The first and second versions are generated based on first and second templates, respectively, where the first and second templates are different. In some embodiments, the first and second templates are algorithmically related.

In some embodiments, a separate template is used for each component of the pixels. For example, a value can be added to the data set for each of the color components of a pixel based on a template used for that component.

In step 140 the image is displayed by successively displaying the first and second versions of the image so as to temporally average the first and second versions. In some embodiments, the image is a still image, and the first and second versions of the image may be repeatedly displayed for the entire time that the image is to be shown on the display. The first and second versions may be repeatedly shown in the same order, or the order may be altered. In some embodiments, more than two versions of the image are generated and displayed. In some embodiments, which of the versions is to be displayed next is randomly or pseudo-randomly determined. In some embodiments, a sequence of all or some of the versions is determined and repeatedly displayed, where the sequence may sometimes be changed.

In some embodiments, the image is part of a series of images, which for example, cooperatively form a video stream. In such embodiments, if the frame rate of the display is 30 frames per second, each frame image may be displayed for about 1/30 second. Accordingly, during the 1/30 second for an image, the first and second versions of each image may each be displayed for about half of the 1/30 second. In some embodiments, the frame rate is different, and in some embodiments, more than two versions are displayed during the frame period.

In some embodiments, all frames use the same dither templates to generate multiple versions of the image of the frame. Alternatively, different templates may be used for sequential frame images. For example, a first frame may use dither templates 1 and 2 to generate first and second versions of the image of the frame, and a next frame may use either or both of templates 1 and 2, or may use either or both of additional templates 3 and 4.

In some embodiments, each of the series of images is displayed by displaying only one version of each image. To create the one version of each image, one of a plurality of templates may be used, such that versions of images adjacent in time are created using different templates. Because images adjacent in time are often similar, using different templates to create dithered versions of each of the images will result in appearance improvement similar to that discussed above where each image is displayed as multiple dithered versions.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A method of displaying images on a display, the method comprising:

generating a first version of a first image according to a first spatial dither template;

generating a second version of the first image according to a second spatial dither template, the second template being different from the first template;

displaying the first image by successively displaying the first and second versions of the first image on the display, wherein the first image comprises two or more color components, and wherein the first and second versions of the first image are generated for each of the color components;

generating a first version of a second image according to a third spatial dither template;

generating a second version of the second image according to a fourth spatial dither template; and displaying the first and second versions of the second image after displaying the first and second versions of the first image, wherein the third and fourth templates are different from the first and second templates.

2. The method of claim 1, wherein the display has a native intensity resolution and the first image is displayed with an effective intensity resolution higher than the native intensity resolution of the display.

3. The method of claim 1, further comprising:

generating one or more additional versions of the first image according to one or more additional spatial dither templates; and successively displaying the first, second and additional versions on the display.

4. The method of claim 3, wherein the display has a native intensity resolution and the first image is displayed with an effective intensity resolution based at least in part on the number of displayed versions of the first image.

5. The method of claim 3, wherein at least one of the additional templates is identical to one of the first and second templates.

6. The method of claim 1, wherein the first image is represented by a series of data sets, each data set representing a pixel of the first image, and generating the first and second versions of the first image comprises modifying one or more of the data sets according to the first and second templates, respectively.

7. The method of claim 6, wherein generating the first and second versions of the first image further comprises thresholding one or more of the data sets.

8. The method of claim 1, wherein the first image is substantially monochrome.

9. The method of claim 1, wherein at least one of the first and second spatial dither templates comprises a plurality of tiled stochastic templates.

10. The method of claim 1, wherein the first and second spatial dither templates are generated so as to have a mathematical relationship to one another.

11. The method of claim 10, wherein the first and second spatial dither templates are configured to reduce image noise because of the mathematical relationship.

12. The method of claim 10, wherein the first and second spatial dither templates comprise threshold values for each pixel, each of the pixels of the first template corresponding to one of the pixels of the second template, and wherein the threshold values for at least some pixels in the first template are inverses of the threshold values of the corresponding pixels in the second template.

13. The method of claim 1, wherein the temporal order of displaying the first and second versions is randomly or pseudo-randomly determined.

14. A method of displaying images on a display having a native intensity resolution, the method comprising:

generating a first version of the first image according to a first template;

generating a second version of the first image according to a second template, the second template being different from the first template;

displaying the first and second versions of the first image such that an effective resolution of the first image is higher than the native intensity resolution of the display, wherein the first image comprises two or more color components, and wherein the first and second versions of the first image are generated for each of the color components;

generating a first version of a second image according to a third spatial dither template;

generating a second version of the second image according to a fourth spatial dither template; and displaying the first and second versions of the second image after displaying the first and second versions of the first image, wherein the third and fourth templates are different from the first and second templates.

15. The method of claim 14, further comprising:

generating one or more additional versions of the first image according to one or more additional templates; and displaying the additional versions to provide further improvement in the effective resolution.

16. The method of claim 15, wherein at least one of the additional templates is substantially the same as one of the first and second templates.

17. The method of claim 14, wherein the first image is represented by a series of data sets, each data set representing a pixel of the first image, and wherein generating the first and second versions of the first image comprises modifying one or more of the data sets according to the first and second templates, respectively.

18. The method of claim 14, wherein generating the first and second versions of the first image further comprises thresholding one or more of the data sets.

19. The method of claim 14, wherein the first and second versions are displayed successively.

20. The method of claim 14, wherein the first image is substantially monochrome.

21. The method of claim 14, wherein at least one of the first and second templates comprises a plurality of tiled stochastic templates.

22. The method of claim 14, further comprising randomly or pseudo-randomly determining a temporal order for displaying the first and second versions, wherein the first and second versions are display according to the determined temporal order.

23. A method of pattern noise mitigation, the method comprising temporally averaging spatially dithered images generated with different spatial dither templates, wherein the dithered images each comprise two or more color components, and each color component is spatially dithered, and wherein a first image is generated with dithered versions of the first image, using at least first and second spatial dither templates, and a second image is generated with dithered versions of the second image, using at least third and fourth spatial dither templates, wherein the third and fourth templates are different from the first and second templates; and wherein temporally averaging the images comprises successively generating and displaying first and second versions of an image on a display.

24. The method of claim 23, wherein the first image is represented by a series of data sets, each data set representing a pixel of the first image, and generating the first and second versions of the first image comprises modifying one or more of the data sets according to the first and second templates, respectively.

25. The method of claim 24, wherein generating the first and second versions of the first image further comprises thresholding one or more of the data sets.

26. The method of claim 23, wherein the display has a native intensity resolution and an image is displayed with an effective resolution higher than the native intensity resolution of the display.

27. The method of claim 23, wherein at least one of the spatial dither templates comprises a plurality of tiled stochastic templates.

28. The method of claim 23, wherein the spatially dithered images are displayed in a randomly or pseudo-randomly determined order.

29. A display array driver and controller circuit configured to temporally average spatially dithered images generated with different spatial dither templates, wherein the dithered images each comprise two or more color components, and each color component is spatially dithered, and wherein the driver and controller is configured to generate a first image with dithered versions of the first image, using at least first and second spatial dither templates, and to generated a second image with dithered versions of the second image, using at least third and fourth spatial dither templates, wherein the third and fourth templates are different from the first and second templates; and wherein said driver and controller circuit is configured to sequentially output different versions of the same image generated with different spatial dither templates.

30. The display driver and controller circuit of claim 29, wherein said display driver and controller circuit is configured to generate a first version of the first image according to the first spatial dither template; and generate a second version of the first image according to the second spatial dither template, the second template being different from the first template.

31. The display driver and controller circuit of claim 30, wherein said display driver and controller circuit is configured to generate one or more additional versions of the first image according to one or more additional spatial dither templates.

32. The display array driver and controller circuit of claim 29, further configured to display the spatially dithered images in a randomly or pseudo-randomly determined order.

* * * * *